US005584951A

United States Patent [19]

MacFarland

[11] Patent Number: 5,584,951

[45] Date of Patent: Dec. 17, 1996

[54] METHOD OF MAKING A BEAM PALLET

[75] Inventor: William W. MacFarland, Cordova, Tenn.

[73] Assignee: International Paper Company, Purchase, N.Y.

[21] Appl. No.: 475,977

[22] Filed: Jun. 7, 1995

Related U.S. Application Data

[62] Division of Ser. No. 268,315, Jun. 30, 1994, Pat. No. 5,425,314.

[51] Int. Cl.[6] ..... B65D 19/00; B32B 31/04

[52] U.S. Cl. ..... 156/207; 156/213; 156/258; 156/293; 108/51.3; 108/56.1

[58] Field of Search ..... 156/207, 213, 156/214, 216, 217, 258, 293; 108/51.3, 51.1, 901, 56.1, 56.3

[56] References Cited

U.S. PATENT DOCUMENTS

| | | | |
|---|---|---|---|
| 3,929,536 | 12/1975 | Maughan | 156/213 |
| 5,461,988 | 10/1995 | Cummings et al. | 108/51.3 |
| 5,487,345 | 1/1996 | Winebarger et al. | 108/51.3 |

*Primary Examiner*—Michele K. Yoder
*Attorney, Agent, or Firm*—Paul E. Hodges, P.C.

[57] ABSTRACT

A disposable pallet made up of paperboard or like material. The components of the pallet include a plurality of base members and a plurality of cross beams which are interlocked in a skeletal-type structure having novel intersections at their cross over locations. A new pallet component and a method for making the pallet are disclosed.

3 Claims, 4 Drawing Sheets

METHOD OF MAKING A BEAM PALLET

This is a division of application Ser. No. 08/268,315, filed Jun. 30, 1994 U.S. Pat. No. 5,425,319.

FIELD OF INVENTION

This invention relates to a disposable pallet for use in the storage and/or transport of goods, and particularly to a disposable pallet made up of paperboard or other similar material.

BACKGROUND OF INVENTION

The common wood pallet which has been the mainstay for storage and transport of goods of many kinds has become more of a burden on industry than heretofore. As transportation costs have risen, the concept of moving Wood pallets back and forth for reuse, which has always been a burden on industry, has become economically prohibitive. Wood pallets offer excellent strength and durability, but even these desirable qualities have proven to be at best questionable justification for the continued use of these pallets.

Moreover, governmental regulations have been brought into effect which limit the ability to reuse or to dispose of any pallet, wood or otherwise, which has become contaminated with any of the hundreds of chemicals listed by the Environmental Protection Agency, for example. Damaged pallets can no longer be repaired economically if the portions thereof which are to be replaced are contaminated. Thus, there is an increasing need for pallets which are disposable economically under current and anticipated regulatory guidelines.

Regardless of their disposability, an acceptable pallet must possess the strength to support their intended loads, it must be sufficiently durable to withstand repeated use and including being lifted, while loaded, using the tines of a fork lift truck. Further, desirably the pallet must resist impregnation thereof by as many of the "contaminating" chemicals as possible, and must resist deterioration by the elements of the weather.

Still further, an acceptable pallet must be competitively priced in the marketplace.

It has been proposed heretofore that pallets be made up of corrugated paperboard, honeycomb paperboard, or other paperboard constructions. Two such pallets are disclosed in U.S. Pat. Nos. 4,977,446 and 5,218,913. These prior art pallets include base stringers and cross stringers each of which is made up from a unitary blank of corrugated cardboard. Multiple parallel panels of tile blank are folded along score lines, for example, using an accordion fold or the like, into a core within which the several panels are disposed in side by side (stacked) relationship;and thereafter are covered by others of the panels of the blank by folding these other panels about the core to define an outer covering for the core. These stringers are made up as individual components and then assembled into a pallet using mating notches formed in the base and/or cross stringers. This prior art pallet suffers from serious problems associated with its manufacture in that the folding requirements associated with the forming of the core and its integral outer cover impose impossible or impracticable dimensional requirements upon the blank. For example, the blank from which the stringer is formed includes a plurality of adjacent panels what are divided by fold lines. In order to form the desired notches in the folded product, several of the panels are initially die-cut with openings through the thickness of the blank at locations such that when the panels of the blank are folded, these openings overlie and are intended to be in register with one another to define the desired notches. Corrugated paperboard normally comes from the mill with a thickness dimension having a tolerance of ±5 mils. Folding this corrugated paperboard into multiple layers tends to compound the effects of the thickness tolerance, so that the width and thickness dimensions of the resulting elongated stringers of this prior art pallet can not be held to that tolerance which is necessary for automatically assembling the stringers into a completed pallet. Especially, known manufacturing equipment is not capable of making up the stringers within the tolerances required for proper fit of the stringers when fitted within their mating notches or openings in other stringers. Also because of this inability to provide stringer components having acceptable dimensional tolerances, one is not able to assemble the base stringers and cross stringers into a stable pallet in which the base and cross stringers retain their desired right angle intersectional orientation at the crossover locations of the assembled stringers.

It has been suggested that the stringers be assembled with an interference fit between mating notches as a means to rigidify the pallet product, but again, the inability to maintain tolerances when folding unitary blanks of corrugated paperboard or the like, and attempting to develop notches in the product by registered individual pre-cut openings in the several panels, prevents the successful use of interference fits in the mating notches. As a consequence of the poorly-fitting of the notches of the stringers at their intersections, in use, when this and other similar prior art pallets are subject to the normal forces encountered in loading, moving and unloading goods on the pallet tend to "work" the mating notches at the intersections, with the result that these joints weaken quickly and the pallet no longer is usable. One other consequence of this inability to establish and maintain acceptable dimensional tolerances in this prior art pallet is the inability to obtain a level, smooth top (or bottom) plane containing the top surfaces of the stringers and onto which there can be applied a linerboard top sheet, for example.

It is an object of the present invention to provide a disposable pallet which is dimensionally stable.

It is another object of the present invention to provide a disposable pallet which can be manufactured, including assembly of the components thereof, expeditiously and economically.

It is another object of the present invention to provide a novel stringer or cross beam component for use in a disposable pallet.

It is another object of the present invention to provide a method for the manufacture of a stringer or beam component for use in the assembly of a disposable pallet.

It is another object of the present invention to provide a method for the manufacture of a disposable pallet.

Other objects and advantages of the present invention will be recognized from the disclosure contained herein, including the claims, and the Figures in which:

FIG. 7 is a side elevational view of one embodiment of a cut covered base stringer useful in assembling one embodiment of a pallet in accordance with the present invention;

FIG. 9 is a top view of the base stringer depicted in FIG. 7;

FIG. 10 is a bottom view of the base stringer depicted in FIG. 7;

SUMMARY OF THE INVENTION

Figure 1:
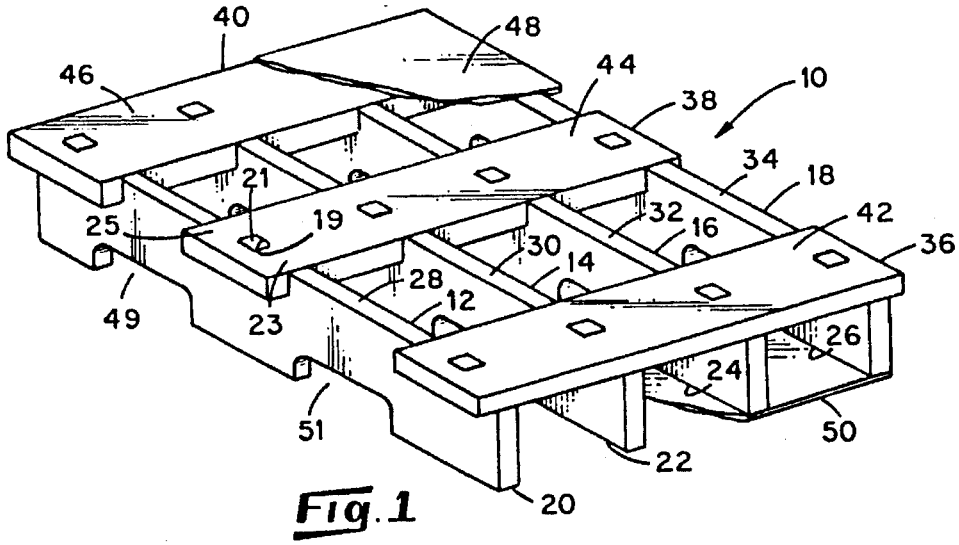
FIG. 1 is a perspective view of a pallet embodying various of the features of the present invention.

In accordance with the present invention, there is provided a disposable pallet of beam-type construction useful in the storage and moving of goods loaded thereon comprising a plurality of elongated base stringers and a plurality of elongated cross beams which are interlocked in a skeletal-type structure. Each of the base stringers and cross beams is of generally rectangular cross section and includes a planar bottom outer surface adapted to rest on a supporting surface to support the pallet and goods disposed on the pallet, a planar top outer surface which receives the goods disposed on the pallet, and opposite side outer surfaces, the outer surfaces being defined by a protective strengthening surround of paperboard or like material.

Each base stringer and cross beam further includes a laminated composite disposed within the inner boundaries of the surround, this laminated composite being made up of a plurality of individual flat rectangular layers of a planar paperboard or like material, such as corrugated paperboard, fiberboard, etc., preferably corrugated paperboard. These layers are overlaid one upon another in stacked fashion with their flat facing planar surfaces being bonded together to form a strong integral elongated laminated composite. The surround is bonded to the laminated composite to integrate the laminated composite and the surround into an integral base stringer or cross beam. Whereas the base stringers and the cross beams may be of the same size and shape when in their precursor stage, as will appear more fully hereinafter, alternatively the base stringers and the cross beams may be different in size and geometry. In like fashion, the number of layers which make up the base stringers may differ from the number of layers which make up a cross beam, depending in major part upon the intended end use of the pallet.

Following the formation of a covered laminated composite base stringer precursor, a plurality of U-shaped notches are cut into each of the base stringers after the formation of the precursor, the notches being disposed in spaced apart locations along the length dimension of a respective base stringer and opening outwardly of the top surface thereof. Each of the notches has a dimension which is oriented with the length dimension of its respective base stringer, immediately adjacent ones of the notches being separated by an upstanding post disposed therebetween. Preferably, each of the posts is of a height substantially equal to the thickness dimension of one of the cross beams and its digital surface lies in the same plane as the plane occupied by the top surface of the base stringer. As required or desired, further U-shaped notches, opening outwardly of the bottom surface of the base stringer, may be cut to provide openings for the receipt of the tines of a lift truck or the like.

A plurality of openings are cut into each of the cross beam precursors after the formation of the precursor. The openings extend through the thickness of a respective cross beam and are disposed at spaced apart locations along the length dimension of the cross beam, and further are spaced between the side surfaces of the cross beam to define an uncut portion of the cross beam disposed on each of the opposite sides or the opening.

To assemble a pallet, the cross beams are assembled with the base stringers, with the cross beams and the base stringers intersecting at substantially right angles at spaced apart cross-over locations that are coincident with the post and opening locations of the base stringers and the cross beams, respectively, and with respective ones of the openings through the thickness of each of said cross beams receiving therein a respective one of the posts of the base stringers. Each of the posts substantially fills its respective opening in a cross beam. Those uncut portions of the cross beam on opposite sides of the opening are received in those notches disposed most adjacent to the post, to thereby form a substantially rectangular pallet having a skeletal structure of interlocked base stringers and cross beams wherein the top surfaces of the cross beams occupy substantially the same plane as the top surfaces of the base stringers and the bottom surfaces of the base stringers occupy substantially a common plane.

DETAILED DESCRIPTION OF INVENTION

Referring to FIG. 1, one embodiment of a disposable pallet 10 embodying various of the features of the present invention includes a plurality of base stringers 12, 14, 16 and 18 whose bottom surfaces 20, 22,24 and 26 are collectively adapted to engage a supporting surface, such a warehouse floor, and including top surfaces 16. These base stringers 12–18 are matingly assembled with a plurality of cross beams 36, 38 and 40 having planar top surfaces 42, 44, and 46 with the top surfaces of the base stringers and the top surfaces of the cross beams occupying a common plane to define a skeletal platform on which a load may be received. As depicted, the top surfaces of the base stringers and of the cross beams may be covered with a top sheet 48 as desired to accommodate a particular loading condition. As desired a similar bottom sheet 50 may be provided on the bottom surfaces of the base stringers. Each of the base stringers is further provided with U-shaped notches 49 and 51 opening outwardly from the bottom surfaces of the base stringers and providing openings for the receipt therethrough of the tines of a fork lift truck or like lifting device.

As depicted in FIGS. 2A, 2B, 3 and 5 in particular, each of the base stringers or cross beams is made up of an elongated laminated composite 52 that includes a plurality of layers 54, 56, 58, 60 and 62 of corrugated paperboard. In turn, this laminated composite is encompassed by a surround 64 (see FIG. 4) which is formed from a sheet of linerboard or like strong and protective material that is sufficiently pliable as to enable the material to be folded in intimate contact with and about the girth of the laminated composite and be bonded thereto to form an elongated covered laminated precursor 66 of a base stringer or cross beam.

Figure 6:
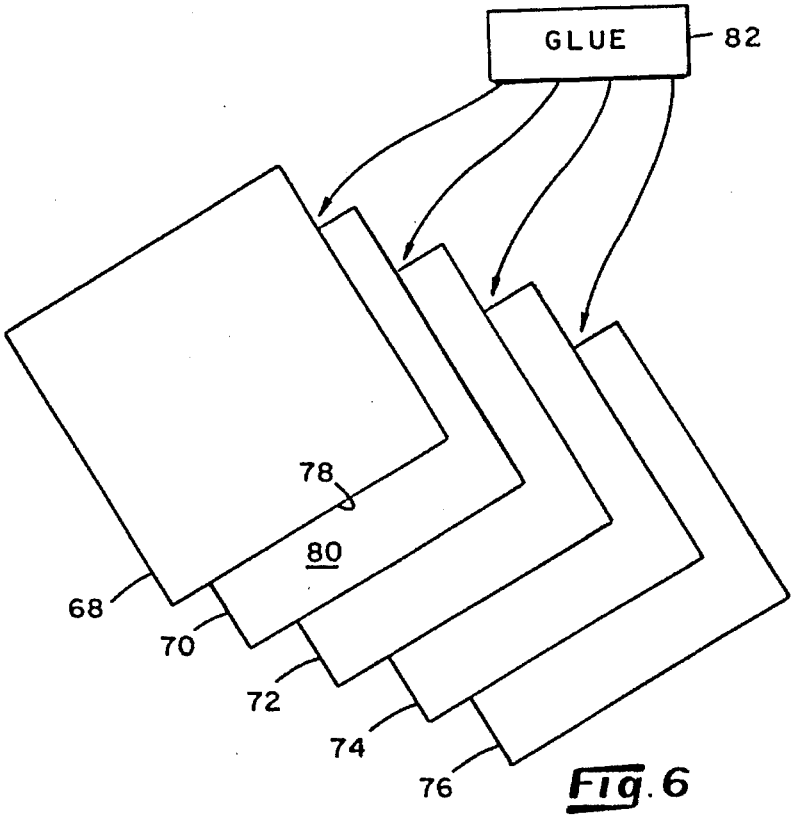
FIG. 6 depicts schematically one method for laying up individual relatively large sheets of corrugated paperboard and applying glue to the facing surfaces of the overlaid sheets to bond the sheets into a laminated composite.

Individual base stringers or cross beams may be formed by different methods, but in each method it is imperative that each of the layers 54–56 be of precise and uniform length and width such that the resultant laminated composite 52 also will be of like precise and uniform length and width. In one method for making up the laminated composite 52, and with reference to FIG. 6, a plurality of relative large sheets 68, 70, 72, 74, and 76 of double-walled corrugated paperboard may be overlaid one on the other with their flat planar surfaces 78 and 80, for example, facing to define a laminated composite with is of a length and width that is a multiple of the desired length and width dimensions of the elongated base stringer or cross beam. The several layers (sheets 68–76) of this composite, while in their flat state, are bonded together by means of adhesive 82 disposed evenly over the facing surfaces of the overlaid sheets. This laminated composite thereafter is cut, as by means of a conventional saw, into individual elongated laminated composites 52 of the desired final length and width dimensions of the base stringer or cross beam. Thereafter, each of these composites 52 is covered with their respective surround 66.

Figure 2A:
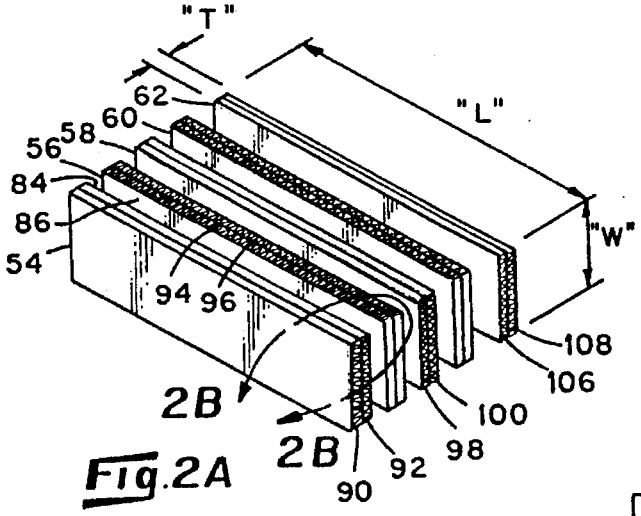
FIG. 2A is an exploded perspective view of one embodiment of individual ones of a plurality of layers of corrugated paperboard suitable for use in making up one embodiment of a non-covered uncut stringer or cross beam component employed in one embodiment of the pallet of the present invention.
Figure 2B:
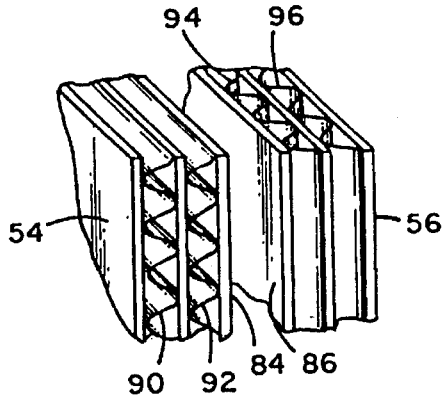
FIG. 2B is a perspective view of one corner of the embodiment of the pallet component depicted in FIG. 2A and taken generally along the line 2B—2B of FIG. 2A.
Figure 3:
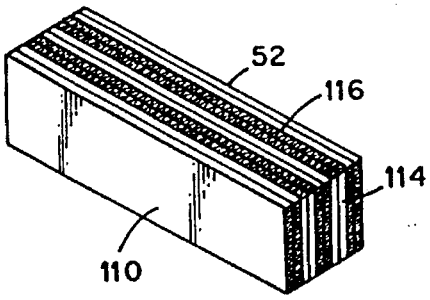
FIG. 3, is a perspective view of a consolidated uncut embodiment of a non-covered stringer or cross beam component formed from the corrugated paperboard layers depicted in FIGS. 2A and 2B and proportioned for clarity.

Alternatively, with reference to FIGS. 2A and 2B, In accordance with one aspect of the present invention, each base stringer or cross beam is formed from individual layers 54–62 of a flat planar sheet of paperboard, fiberboard or the like, preferably corrugated paperboard. Each of these layers is of precise width dimension, "W", length dimension, , "L", and thickness dimension, "T", all layers being of essentially the same, width, length and thickness. The width and length dimensions of a layer are chosen as a function of the desired size of the assembled pallet as will appear more fully hereinafter. Each layer includes opposite flat planar surfaces 84 and 86, for example. To assemble the layers into a coherent composite 52 (see FIG. 3), a plurality of the individual layers are stacked with respective ones of their flat planar surfaces facing as depicted in FIGS. 2A and 2B. The facing flat surfaces are bonded to one another as by means of an adhesive 88 (see FIG. 6), preferably using an adhesive that is disposed evenly over the area of the facing flat surfaces.

The number of layers chosen to be included in a given laminated composite is dictated by the desired thickness dimension of the base stringer or the cross beam. The present inventor has found that at least four and preferably five individual layers of double-walled corrugated paperboard bonded into a coherent laminated composite provide the properties desired for use of the base stringer or cross beam in a disposable pallet for most anticipated loadings of the pallet. Further, it has been found that in the preferred base stringer or cross beam composite which is made up of corrugated paperboard layers, it is preferred that tile corrugation flutes of the layers be oriented in alternating directions within the stack. That is, referring to FIGS. 2A and 2B, the corrugation flutes 90 and 92 of a first double-walled outer layer 54 may be oriented with the length dimension "L" of the stack elongated composite 52, the flutes 94 and 96 of the double-walled second layer 56 oriented with the width dimension "W" of the stack, the flutes 98 and 100 of the third double-walled layer 58 oriented with the length dimension of the stack, the flutes 102 and 104 of the fourth double-walled layer 60 oriented with the width dimension of the stack, and the flutes 106 and 108 of the fifth double-walled layer 62 oriented with the length dimension of the composite. In this manner, the strength properties of the composite are enhanced, while employing a minimum or optimum number of layers of the corrugated paperboard and minimizing the cost of manufacture of the composite. In the forming of the composite from the several stacked layers, after their assembly into a stack with the adhesive disposed between layers, the stack preferably is compressed with that degree of pressure which not only ensures good contact between the facing surfaces of the layers, but which also compresses the overall height of the stack to that extent which establishes the desired overall thickness dimension of the resulting composite. This compression is less than that which deleteriously affects the strength properties of the individual layers or the overall composite, but it has been found that small degrees of compression of the stack can be used to repetitively produce composites having essentially the same thickness dimension. This feature of uniformity of width, length and thickness dimensions of the composite are of importance in the assembly and in the establishment of the ultimate properties of the pallet product, such as strength, ruggedness, ability to withstand abuse during use, etc.

Figure 4:
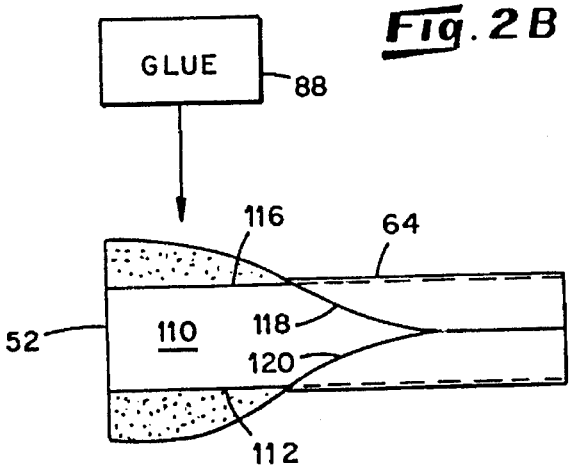
FIG. 4 is a view diagrammatically showing the application of a linerboard surround to the uncut component depicted in FIG. 3.
Figure 5:
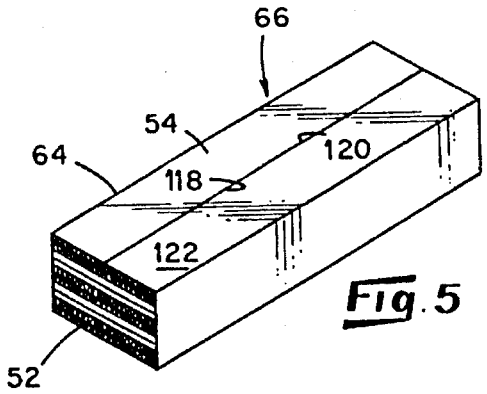
FIG. 5 is a perspective view of a covered uncut stringer or cross beam precursor and proportioned for clarity.

As depicted in FIGS. 4 and 5, the laminated coherent composite 52 of bonded layers of corrugated paperboard is covered about its girth by means of a surround 64 comprising a sheet of linerboard or like material to form a base stringer or cross beam precursor. As depicted, the surround 64 is wrapped about the girth of the composite 52 and bonded to the outer surfaces 110, 112, 114 and 116 thereof to thereby integrate the surround 64 and composite 52 into a integral base stringer precursor or cross beam precursor, indicated generally by the numeral 66 in FIG. 5. The width or the surround before wrapping is chosen such that when the surround is wrapped about the girth of the composite, the edges 118 and 120 of the surround essentially meet along a line which is approximately midcenter of the outer bottom surface of the composite. These edges preferably do not overlap one another, so that the result is a smooth outer bottom surface 122 of the base stringer or cross beam precursor. The preferred surround for use in the present invention is a sheet of linerboard having a basis weight of at least about 57 lb per 1000 $ft^2$. This linerboard surround serves to protect the laminated composite from weather elements, water, organics such as lubricants, and other materials which might serve to weaken the base stringer or cross beam during use of a pallet, and serves also to enhance the strength properties of the base stringer or cross beam. These functions of the surround would appear to require a material which is thicker, heavier and stronger than linerboard, and in fact outer coverings of the prior art are made up of such other materials. For example, corrugated paperboard outer coverings in various forms have been proposed in the prior art. The present inventor, however, has found that through the use of a combination of the precisely dimensioned laminated composite and a linerboard surround which is readily foldable and which conforms fully to, and is bonded to the top, bottom and side surfaces of the laminated composite, one can provide the desired protection and strength properties to the base stringer or cross beam. Unexpectedly, this ability has been found by the present inventor to be attainable using a linerboard having a basis weight of not more than about 90 lb per 1000 $ft^2$. Linerboard having a basis weight below about 57 lb per 1000 $ft^2$ does not provide the required degree of properties enhancement for the resulting base stringer or cross beam, and linerboard having a basis weight greater than about 90 lb per 1000 $ft^2$ has been found to be insufficiently flexible and conformable as permits it to be folded and wrapped in sufficiently conforming relationship to the outer surfaces of the laminated composite as provides the development of the required properties enhancement. In accordance with one aspect of the present invention, the linerboard of the surround may be treated to enhance its strength, resistance to liquid penetration and/or other desirable properties thereof, these treatments being well known in the art.

Figure 11:
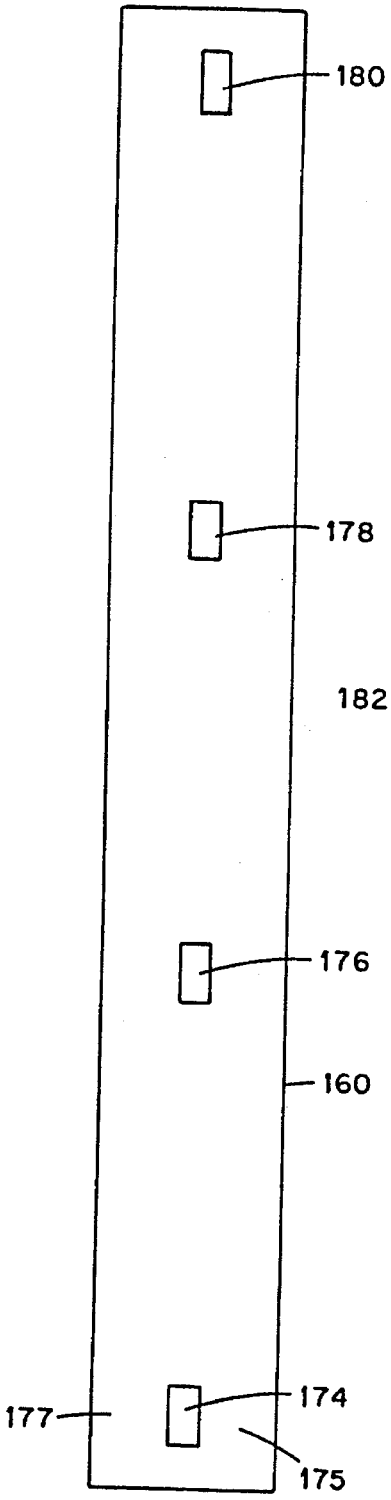
FIG. 11 is a top plan view of a cut covered cross beam component useful in assembling one embodiment of a pallet in accordance with the present invention.
Figure 13:
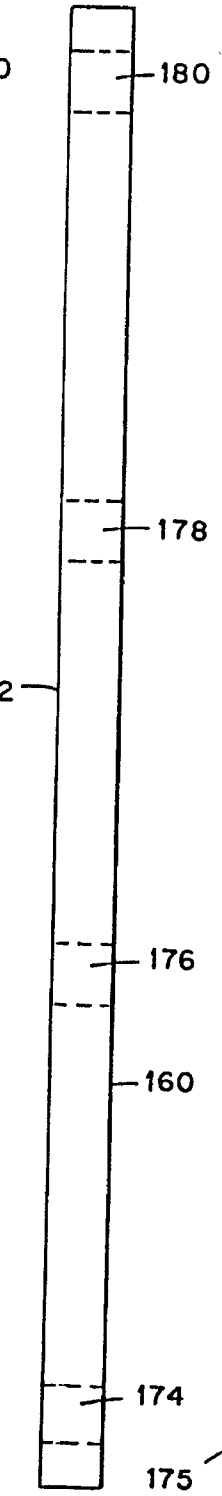
FIG. 13 is a side view of the cross beam depicted in FIG. 12.
Figure 14:
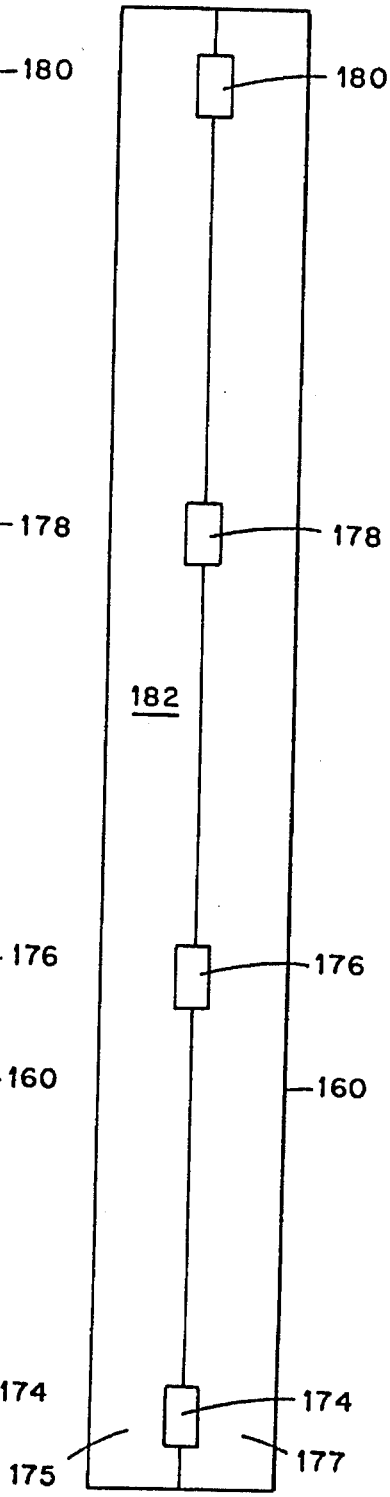
FIG. 14 is a bottom plan view of the cross beam depicted in FIG. 11.
Figure 12:
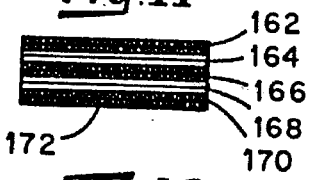
FIG. 12 is an end view (enlarged for clarity) of the cross beam depicted in FIG. 11.

In FIGS. 7–10 there is depicted one embodiment of a base stringer 122 useful in the manufacture of a disposable pallet in accordance with the present invention. The depicted base stringer 122 is made up of five layers 124, 126, 128, 130 and 132, each layer being of double-walled corrugated paperboard, plus a linerboard surround 134, with the flutes of layers 124, 128 and 132 being oriented substantially parallel with the length dimension of the base stringer 122. The flutes and of the layers 126 and 130 are oriented with the width dimension of the base stringer so that in use, these flutes will be oriented vertically. The depicted base stringer includes a plurality of notches 136, 138, 140, 142, 144, and 146 opening outwardly of the top surface 148 of the base stringer. In all instances except at the opposite ends 150 and 152 of the base stringer, these notches are generally U-shaped when viewed in a side view, and preferably or rectangular cross-sectional geometry and are preferably provided with square corners at all sides thereof. Importantly, between adjacent ones 136 and 138, for example, of the notches, there is defined an upstanding post 154. This post projects in a direction outwardly of the top surface 148 of the base stringer and preferably is of a rectangular cross section and having square corners. In another embodiment, the post may be substantially square in cross section with each side of the cross section thereof being substantially equal to the thickness dimension of the base stringer. Further, preferably, the combined dimensions of each combination of adjacent notches and accompanying post, notches 136 and 138 and post 154, for example, which is parallel with the length dimension of the base stringer is substantially equal to the width dimension of a cross beam, thereby causing the uncut portions 175 and 177 (see FIG. 11) on opposite sides of a given opening 174, for example, through the thickness of a cross beam to be received snugly and conformably in respective ones of the notches (see also FIG. 15). This close conformity of the base stringer and cross beam at their intersecting locations establishes a strong intersection having a multiplicity of vertical facing surfaces that tend to support one another and resist rotational type movements of the base stringer and cross beam at each of their intersections. The number of notch/post combinations provided for each base stringer is dictated by the number of cross beams which are to be assembled with the base stringers in the formation of the pallet. In the embodiment depicted in FIGS. 7–10, posts 157 and 159 are provided between adjacent notches 140 and 142, and between adjacent notches 144 and 146, respectively.

In the embodiment of a base stringer as depicted in FIG. 7, the end notches 136 and 146 open outwardly of the top surface 148 and outwardly of their respective one of the ends 150 and 152 of the base stringer. By this means, one is able to position the outermost cross beams 36 and 40 (see FIG. 1) flush with the ends 150 and 152 of the base stringers thereby eliminating an overhand of the cross beams in these locations, and thereby providing substantially uniform load-bearing strength of the pallet even at these edges of the pallet.

With reference to FIGS. 11–14, one embodiment of a cross beam 160 useful in the manufacture of the pallet of the present invention includes five layers 162, 164, 166, 168 and 170 of double-walled corrugated paperboard with a linerboard surround 172. The directional orientation of the flutes of the several layers preferably is alternated between orientation parallel to the length dimension and the width dimension of the cross beam to enhance the strength of the cross beam, particularly the bending strength, and to enhance the resistance of the cross beam to twisting along its length. In the depicted embodiment the flutes of three of the layers 162, 166 and 170 are oriented with the length dimension of the cross beam and the flutes of the other two layers 164 and 168 are oriented with the width dimension of the cross beam. Each cross beam 160 is provided with a plurality of openings 174, 176, 178, and 180 located at spaced apart locations along the length of the cross beam and which extend through the thickness dimension of the cross beam. Preferably each opening extends fully through the thickness of the cross beam, but it is recognized that each opening could be in the form of a recess which opens outwardly of the bottom surface 182 of the cross beam. In this respect, if desired, each of the posts of a mating base stringer could be formed of reduced height such that when received within a respective recess in a cross beam, the top surfaces of the cross beam and of the base stringer would occupy a common top plane. This embodiment is more costly to manufacture and is more prone to dimensional errors during manufacture and therefore less desirable.

Each of the openings 174, for example, through the thickness of a cross beam preferably is of rectangular cross sectional geometry, and is provided with substantially square corners. In any event, in order for the cross beam to be matingly joined with cooperating base stringers, the openings must be of like cross sectional geometry as the cross sectional geometry of the posts of the base stringers so that the posts may be received within the openings. Preferably, each opening is the same size in cross sectional area as a post which is to be received therein, thereby providing for close fit of the post within the opening, but not employing any material interference fit therebetween. In this manner, the cross beams may be readily assembled with appropriate base stringers using automated equipment and without the necessity of applying undue force. Preferably, the height of each post is chosen to cause a post to fully fill its mating opening.

In a specific example of a disposable pallet as depicted in FIG. 1, incorporating various of the features of the present invention, the base stringer precursors were each formed of five layers of corrugated paperboard and covered about their girth with a sheet of linerboard. In this example, the corrugated paperboard was double-walled and made up of liners having a basis weight of 33 lbs per 1000 $ft^2$ and corrugating medium having a basis weight of 32 lbs per 1000 $ft^2$. Three of these layers had their flutes oriented parallel to the length dimension of the precursor and the flutes of the other two layers were oriented parallel to the width dimension of the precursor. Adhesive was used to bond the layers into the desired laminate. The laminate was covered about its girth with a surround of linerboard having a basis weight of 69 lbs per 1000 $ft^2$, the surround being bonded to the laminate using adhesive. Each base stringer was five inches in width, forty-eight inches in length and one and seven-eighths inches in thickness. Four such base stringers were assembled with three cross beams.

Each of the cross beams in this example, was made up from four doubled-walled layers of corrugated paperboard of the same basis weight as the base stringers, and covered with a surround which was the same as the surround of the base stringers. All flutes of the corrugated paperboard were oriented parallel to the length dimension of the cross beam. Each cross beam was seven and three-fourths inches in width, forty inches in length and one and nine-sixteenths inches in thickness.

Posts of a square cross sectional geometry were provided intermediate adjacent notches opening outwardly of the top surface of each base stringer. Each post measured one and seven-eighth inches per side thereof and had a height of one and seven-eighth inches, the top surface of the post terminating coplanar with the top surface of the base stringer. Each notch had a length dimension of two and fifteen-sixteenth inches in a direction that was parallel to the length dimension of the base stringer, and a width dimension equal to the thickness of the base stringer which in the present example was one and seven-eighth inches Three sets of posts and adjacent notches were provided for each base stringer. All corners of the posts and notches were square, i.e. not rounded or radiused.

Each cross beam was provided with four openings spaced apart along the length dimension of the cross beam. Each opening extended fully through the thickness of the cross beam and was of a square cross sectional geometry, each side of the opening measuring one and seven-eighth inches. All corners of the openings were square, i.e. not rounded or radiused. Thus, each opening was precisely dimensioned to receive therein a post of the base stringer when the cross beams and stringers were assembled into their skeletal arrangement as depicted in FIG. 1, for example.

All notches, posts and openings of the base stringers and of the cross beams were cut after the formation of the covered laminated composite precursors were formed, using a band saw or the like to ensure accurate cuts and square corners. In this manner, the notches are formed with precise dimensions and interconnection of the intersecting base stringers and cross beams via their respective notches, openings and posts is readily carried out. As noted, the close fit of the mating notches, openings and posts establishes a strong intersection and enhances the strength properties or the resulting pallet. Further, by cutting the notches, openings and posts after the base stringer or cross beam has been provided with its surround, the cutting operation is more efficiently carried out, the cuts are cleaner and their respective dimensions may more readily be maintained. Still further, when a notch or post is cut or formed after the base stringer or cross beam precursor has been formed, one can easily and readily locate each notch or post at the desired location on the base stringer or cross beam, and the notch or post location is precisely repeatable from one base stringer or cross beam to the next in a production operation. This capability enhances the ease of assembly of the stringers and cross beams, in addition to enhancing the strength properties of the resulting pallet as referred to hereinabove. In accordance with one aspect of the present invention, the top surface of each post remains covered with a portion 190 of the surround which is not cut away during the formation of the post.

The cross beams of his example were assembled with the base stringers, the cross beams and base stringers intersecting at right angles to one another and with the posts of the base stringers being received in respective openings in the cross beams as depicted in FIG. 1. Notably, no force fit pressure was required for the assembly, but rather, the mating elements of the several components of the pallet readily fit together snugly and the top surfaces of the base stringers and the top surfaces of the cross beams occupied a common plane. All intersections were bonded with adhesive. A top sheet of corrugated paperboard was overlaid on and adhesively bonded to the top surfaces of the base stringers and the cross beams to provide a planar load-bearing surface for the pallet. Because the top surface of each post was covered with protective surround, and this top surface was flush with the top surfaces of the stringers and cross beams, the posts formed continuations of the top surfaces of the stringers and cross beams, thereby preventing any discontinuity of the planar load-bearing surface of the pallet. Further, the surround on the top surface of each post provided protection against the penetration of liquids into each post which would tend to weaken the post and/or contaminate the pallet. Still further, a bottom sheet was adhesively bonded to the coplanar bottom surfaces of the base stringers of the pallet.

It will be recognized hat the pallet of the present invention is formed of readily disposable materials, e.g. paperboard, that is not harmful to the environment. The pallet is economical to manufacture, the cost of the paperboard used being less than the cost of plastic or wood,required to make a like sized pallet having equivalent load-bearing capability. Surprisingly, the strength and durability, e.g. ruggedness and ability to sustain repeated use without destruction, of the present pallet was unexpectedly greater than anticipated. These features of the present pallet are attributable in large measure to the use of the fully conformable surround bonded to the laminated composite, precisely dimensioned mating elements of the base members and cross beams, and the increased use of square corners at the intersections of the base members and cross beams. These features are not attainable when forming the base stringers and/or cross beams by folding of a pre-cut and scored unitary blank of corrugated cardboard, for example, and it is believed that these features have eliminated the major weaknesses of the prior art paperboard pallets which, during use, tended to weaken quickly at the intersections of the base stringers and cross stringers, such as in the pallets disclosed in U.S. Pat. Nos. 4,979,446 and 5,218,913. Further, the present pallet is highly resistant to damage at the intersections of the base stringers and cross beams, such as when a corner of the pallet is struck against a wall, a post, shelving or the like when being moved about by means of a fork lift. Again, this feature is attributed in major part to the novel intersectional geometry provided by the present inventor and its ability to preclude the problems of stability and durability at the intersections of the prior art paperboard pallets.

Still further, the relatively broad width of the cross beam, relative to the width of its accompanying base member, of a preferred embodiment of the present pallet has been found to play an important role in the stability and durability of the present pallet. In particular, the combination of a post disposed between adjacent notches in the base stringer and the provision of an opening through the thickness of a cross beam at a location wherein the cross beam width at the location of the opening therethrough is such as to fill the notches on opposite sides of the post, has been found to impart unexpectedly good rigidity to the intersection of the base stringer and cross beam, presumably in part by the geometrical nature of the mating post, opening and adjacent notches at each intersection of a base member and cross beam. This feature is enhanced by the relatively wide width of the cross beam itself. Specifically, preferably the width of the cross beam of the present invention is greater than its thickness. Relatively thicker cross beams, with or without regard to the width of the cross beam, may be used, but the added cost due to the additional material used to construct the cross beam does not encourage its use. In a preferred embodiment, the width of a cross beam is not less than about two times the thickness of a mating intersecting base stringer and preferably about three times the thickness of a mating intersecting base stringer. This relationship between width of the cross beam and thickness of the base stringer permits one to configure the post and opening geometries to cause the opening through the cross beam to be centered between the side edges of the cross beam and to occupy less than about one-third of the width of the cross beam, thereby leaving uncut portions of the cross beam on opposite sides of the opening, such portions each being at least equal to the thickness of the base stringer. This further permits the combination of a post and adjacent notches in the base stringer to have a combined length (measured parallel to the length dimension of the base stringer) that is equal to the width of the cross member, thereby providing for maximum continuity of the walls of both the base stringer and the cross beam at their intersection, and resultant enhancement of the strength of the intersection.

Figure 15:
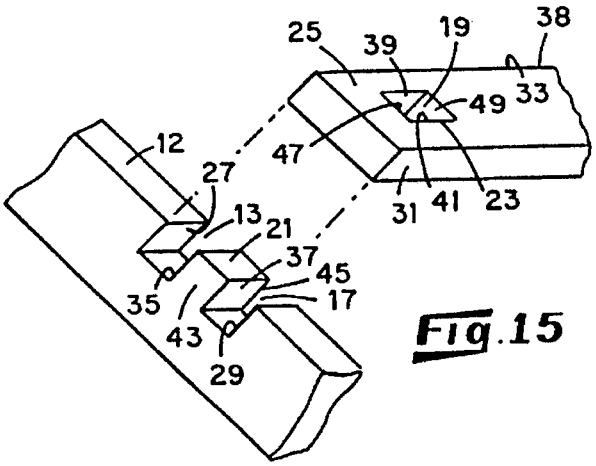
FIG. 15 is a fragmentary representation (exploded) of one embodiment of an intersection of a base stringer and a cross beam and showing the relationship of the several mating vertical surfaces at the depicted intersection.
Figure 8:
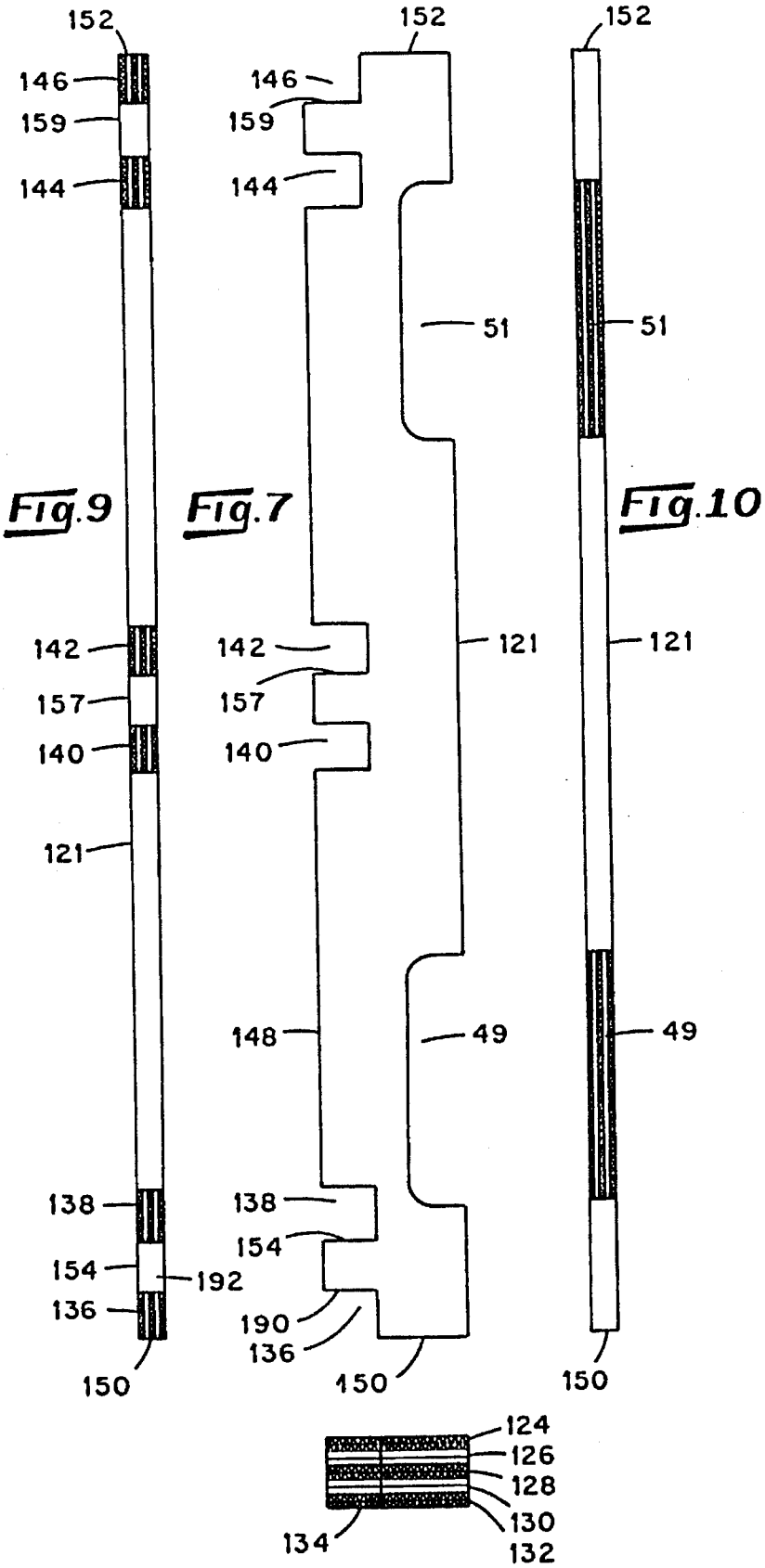
FIG. 8 is an end view of the base stringer depicted in FIG. 7.

With reference to FIG. 15 in a preferred embodiment of a pallet embodying various of the features of the present invention, each intersection of a base member 12 with a cross beam 38 includes a plurality of vertical (when assembled in a pallet) flat surfaces on each of the base member and cross beam. Respective ones of these vertical surfaces engage when the pallet is assembled. Each of the notches 13 and 17 of each base stringer 12 include a plurality of vertical (when assembled in a pallet) flat surfaces 27 and 35 and 29 and 37, respectively Each post 21 of the base stringer includes vertical flat surfaces 43 and 45, and shares the surfaces 35 and 37 with the notches 13 and 17, respectively, thereby providing a total of six vertical flat surfaces on the base member at each intersection of a base member and a cross beam. Each opening 19 of each cross beam 38 defines further vertical flat surfaces 39, 41, 47 and 49. These vertical flat surfaces on the cross beam engage respective ones of the vertical flat surfaces of the notches and post of the base member when the base member and cross beam are assembled into a pallet, and due to the individual precise dimensioning of the notches, post and opening, these engaging vertical flat surfaces effectively permit the notches to be filled with the uncut side portions 23 and 25 of the cross beam and further permit the post 21 to essentially fill the opening 19 so that there is substantial continuity of the base member and the cross beam and they complement the strength of one another. Further, this close conformity of the several components at each intersection of a base member and a cross beam contributes materially to the ability of the intersection to resist rotational movements of the base member and the cross beam with respect to one another. In a preferred embodiment, each intersection of a base member and cross beam of a pallet in accordance with the present invention includes at least seven engaging vertical flat surfaces, namely surfaces 27, 35, and 37 on the base member and surfaces 39, 41, 47 and 49 on the cross beam, for example, and preferably at least nine engaging vertical flat surfaces per intersection, including the surfaces 43 and 45 of the post 21, for example. Specifically, when the cross beam 38 is assembled with its opening 19 receiving therein the post 21 of the base stringer, and with the uncut lateral portions 23 and 25 of the cross beam received within the notches 13 and 17, the vertical surfaces 27 and 29 of the notches 13 and 17 will engage the vertically oriented side surfaces 31 and 33 of the cross beam, the vertical surfaces 35 and 37 of the post 21 will engage the vertical surfaces 39 and 41, respectively, of the opening 19, and the vertical side surfaces 43 and 45 of the post 21 will engage he vertical surfaces 47 and 49 of the opening 19, thereby providing a total of six sets of mating and engaging vertical surfaces at this intersection. In the situation where the intersection is located at an end of a base stringer, because the most endward notch of the base stringer has one fewer vertical surfaces that when the intersection is located more centrally of the length of the base member, this end intersection will include one less set of mating vertical surfaces, or a total of five sets. In a preferred intersection construction as depicted in FIG. 15, there is provided at least six sets of engaging vertical surfaces.

As noted, due to the precise dimensioning of the individual elements of the base stringers and cross beams, and the resulting precise dimensioning of the base stringer and cross beam products themselves, one is readily able to automate the assembly of the base stringers and cross beams into a pallet product. By this means, one is further able to repeatedly assemble identical pallets, each having the same desirable properties.

One versed in the art will recognize variations of the present invention. For example, if desired, the posts and mating openings may be of a cross sectional geometry other than rectangular, such as triangular or other polygonal cross sectional geometry. In general, within limits, the larger the number of vertical surfaces within a given intersection which engage one another, the greater is the ability of the intersection to withstand those forces which, in use of the pallet, tend to damage the intersection and weaken or destroy he pallet. As noted, in a preferred embodiment of the present invention, there are at least seven such vertical and engaging surfaces at each intersection, all of which are disposed within the plane of the cross beam, and thereby located immediate to the central vertical axis or rotation of the base stringer and cross beam at their intersection. Displacement of the engaging surfaces out of the plane of the cross beam tends to reduce the effectiveness with which the engaging surfaces can resist rotation of the base member and cross beam away from their right-angle intersection, and results in the loss of the ability of the intersectional geometry to resist damage. Multiplication of the number of vertical engaging surfaces beyond about fourteen, such as when the post is made with a pentagonal cross section, tends to reduce the area of each of the engaging vertical surfaces that are associated with the post of the base member and the mating opening of the cross beam and hereby reduces the ability of the intersection to resist rotational movement of the base member with respect to the cross beam.

Other variations and embodiments of the invention will be recognized by one skilled in the art, and it is intended that the invention be limited only as set forth within the claims appended hereto.

What is claimed:

1. A method for the manufacture of a disposable pallet comprising base stringers and cross beams comprising the steps of:

a. forming said base stringers and cross beams by providing a plurality of flat planar elongated layers of a corrugated paperboard, each layer being like dimensioned as all other of said layers and having opposite side edges and opposite flat surfaces, overlaying said elongated layers one on another in stacked relationship, bonding said facing flat surfaces of said stacked sections to one another to form an integral laminated composite, covering said laminated composite with a sheet of linerboard and wrapping said linerboard about said elongated laminated composite to form a base stringer or cross beam having top, bottom and opposite side surfaces, b. thereafter forming a plurality of U-shaped notches opening outwardly of said top surface of said base stringers and leaving portions of said top surface of said base stringers remaining so as to form a plurality of posts intermediate adjacent ones of said notches, c. forming a plurality of openings through the thickness of said cross beams at spaced apart locations along the length dimension of said cross beams, and d. thereafter interconnecting said base stringers with said cross beams in right angle intersecting relationship therebetween and with the openings of said cross beams receiving therein said posts of said base stringers.

2. The method of claim 1 wherein each post on said base stringers is formed with a substantially rectangular cross-section.

3. The method of claim 1 and including the step of bonding a top sheet of corrugated paperboard on the top surfaces of the assembled base stringers and cross beams to provide a planar load-bearing surface for the pallet.

* * * * *